US005925171A

United States Patent [19]

Pietrobon

[11] Patent Number: 5,925,171

[45] Date of Patent: Jul. 20, 1999

[54] VACUUM CLEANER APPARATUS, OF THE TYPE HAVING AN INNER CONTAINER PARTIALLY SUBMERGED IN WATER

[76] Inventor: Silvano Pietrobon, Via Montegrappa, 119B, I-31010 Fonte, Italy

[21] Appl. No.: 08/582,992

[22] PCT Filed: Jul. 18, 1994

[86] PCT No.: PCT/IT94/00116

§ 371 Date: Jan. 22, 1996

§ 102(e) Date: Jan. 22, 1996

[87] PCT Pub. No.: WO95/02986

PCT Pub. Date: Feb. 2, 1995

[30] Foreign Application Priority Data

Jul. 22, 1993 [IT] Italy ..... TV93A0070
May 16, 1994 [IT] Italy ..... TV94A0052

[51] Int. Cl.[6] ..... B01D 47/02

[52] U.S. Cl. ..... 96/342; 15/353; 261/123

[58] Field of Search ..... 55/255, 256, 250, 55/252, 253; 15/353; 261/123

[56] References Cited

U.S. PATENT DOCUMENTS

| | | | |
|---|---|---|---|
| 1,288,393 | 12/1918 | Di Sante | 55/255 |
| 1,851,427 | 3/1932 | Hinkle | 55/253 X |
| 1,949,212 | 2/1934 | Lowther | 55/255 X |
| 2,083,649 | 6/1937 | Heglar | 55/255 X |
| 2,397,525 | 4/1946 | Bennett | 55/253 X |
| 2,902,112 | 9/1959 | Lowther | 55/253 |
| 3,844,748 | 10/1974 | Lanier | 55/255 |
| 4,888,849 | 12/1989 | Hult et al. | 15/353 X |
| 5,205,014 | 4/1993 | Yoo | 55/250 X |

FOREIGN PATENT DOCUMENTS

| | | | |
|---|---|---|---|
| 827982 | 5/1938 | France | 55/253 |
| 845907 | 9/1939 | France | 55/255 |
| U-9012775 | 1/1991 | Germany . | |
| A-4107535 | 9/1992 | Germany . | |
| 401310 | 1/1943 | Italy | 55/255 |
| TV91A0117 | 8/1995 | Italy . | |
| TV92A0005 | 2/1996 | Italy . | |
| OCTR001 | | | |
| 32508 | 11/1933 | Netherlands . | |

OTHER PUBLICATIONS

Hiroshi, Miki, *Patent Abstracts of Japan*, vol. 17, No. 685 (C–1142), Dec. 15, 1993.

Shigeo, Kahayashi, *Patent Abstracts of Japan*, vol. 15, No. 425 (C–0879), Oct. 29, 1992.

*Primary Examiner*—Richard L. Chiesa
*Attorney, Agent, or Firm*—Workman, Nydegger & Seeley

[57] ABSTRACT

A vacuum cleaner having a novel filter apparatus is disclosed. The vacuum cleaner includes a body for the support of a suction group and a container for holding a quantity of water and a filter assembly, a portion of which is submerged in the water. The filter assembly consists of a first filter and a second filter. The first filter is composed of an air distributor that is at least partially submerged in the water. The second filter, being fixed above and in proximity to the first filter, is formed from process vegetable and/or animal fibers.

12 Claims, 8 Drawing Sheets

VACUUM CLEANER APPARATUS, OF THE TYPE HAVING AN INNER CONTAINER PARTIALLY SUBMERGED IN WATER

This invention has for object a vacuum cleaner apparatus of the type having an inner container partially submerged in water.

The innovation finds particular even if not exclusive application in the sector of electric and professional appliances destined to clean environments to perfection.

At the present stage of technology, vacuum cleaner apparatuses are well known. The more traditional ones are composed essentially of a body, supported by feet or rotating wheels, inside of which is provided a motor group to suction the external air jointly with the dirt, to be filtered and then re-introduced into circulation. Such an apparatus, suctioning the air through a nosepiece held by the user, commonly allows, depending on necessity, the cleaning of dust from carpets, mats, reed-mats, fitted carpets, and similar surfaces, as well as the actual floor. The suctioned air first passes through at least one filter, which generally consists of the dustbag itself, then once filtered is re-introduced, as we have seen, in the surrounding environment. Generally, the dustbag-filter is made of a particular type of fine-meshed cloth, allowing the circulation of the suctioned air, but retaining inside the large dust particles and general grit.

In the solution shown above, different drawbacks are noticeable. Amongst these, firstly noticeable is the fact that a careful cleaning of a surface undergoing treatment is not possible, but also the fact that an enormous quantity of superfine dust is re-introduced, which once vacuumed and removed cannot be retained by the traditional dustbag-filter. Furthermore, it is somewhat common knowledge that this superfine dust seems to be the cause of innumerable allergies suffered by individuals living within the household walls and causes them to suffer annoying symptoms.

A recent solution has consisted in providing a form combined with a traditional vacuum cleaner, the use of a device suitable also for the simultaneous washing of surfaces. More in particular, such an apparatus always consists in one movable body to which a suction motor group is associated, but which has an internal tank which contains water to be distributed onto the surfaces to be treated. The air, together with the water previously dispersed from a delivery device applied to the nosepiece, is subsequently suctioned and therefore introduced into the interior of the tank. Here, a kind of perpendicular fan placed in correspondence with the exit hole of the suctioned air, by rotating, creates a depression zone which, while blocking the reintroduction of the dust, agitates at the same time both the water and the air. One therefore obtains a precipitation of dust and water thanks to its catalytic effect, discharging into the surrounding environment only air, partially purified of such wastes. But also in such a case drawbacks are noticeable, which consist firstly in the fact that the aforesaid apparatus cannot operate exclusively as a vacuum cleaner. Secondly, treating the surfaces with liquids leaves them quite damp for a short period, which limits their use. The third but not last aspect is that it appears to be a somewhat complicated apparatus that does not allow further optimization of the filtering function of the suctioned air.

In DE.A,4107535 and in the IT patent application n.TV91A000117, a particular vacuumcleaner and relative filter apparatus is described, in which is provided a body for the support of a suction group and a container, in the interior of which is used, in contact with a quantity of previously introduced water and in proximity to the suction mouth, a filter, said filter being obtained from vegetable and/or animal fibres. Also state of the art is the IT patent application n.TV92A000005, consisting of an improvement to the preceding patent, in which is foreseen the fact that inside the container there is:

- a first filter, being composed of an air distribution means at least partially submerged in a quantity of water contained in the underlying basin, the afore-mentioned being directly connected to the suction means of the air drawn from the exterior;
- a second filter, being fixed above and in proximity to the said means of distribution of the suctioned air and obtained from processed vegetable and/or animal fibres;
- water previously introduced into the underlying containing basin, which submerges at least partially the said air distribution means.

One of the aims of the present application is also to resolve some of the drawbacks noticeable in the use of the preceding apparatuses. More in particular, one could detect that the worst problems are concentrated in the type of filter which, besides not being easily accessible, frequently becomes clogged thus requiring constant maintenance even to the point of requiring resetting after each use. As a result, during the cleaning operations the vacuum cleaner will have a substantial progressive reduction in filtering power, therefore losing the benefits for which a certain apparatus type was selected, but above all rendering useless even the more traditional cleaning operations. Another drawback is the fact that it is not able to clean up liquids which happen to be dispersed, limiting itself predominantly to suctioning only air along with general dust. In fact, increasing the level of liquid inside the container could interfere with the functioning of the motor, which could be subject to possible damage, and become dangerous.

This and other aims are achieved with the present innovation according to the characteristics of the included claims solving the exposed problems by means of an improved vacuum cleaner apparatus of the type essentially subdivided into two parts, respectively; a first upper part that includes the support body of a suction motor group located in an opening coated with acoustic insulating material and placed in a first filter disposed in a ring fashion, and a lower part consisting in:

- a water container, essentially conical, held perimetrically by means of a levered hook, to the said body;
- a cylindrical element without extremities, inside the said container, held up along the edge and partially immersed in the water, having between the facing walls, perpendicular to the bottom, an annular interspace, consisting of a siphon which becomes the compulsory passage for the air and/or liquid drawn from the exterior through the suction means;
- at least one dirt separator disc being placed at the base of the cylindrical element and submerged in the water provided in the container, said cylindrical element having several openings at its base;

and one or more filters even of differentiated density, not in contact with the water, where one filter is held up by the cylindrical element, defining an intermediate air cushion.

In such a way by means of the notable creative contribution which constitutes an immediate technical progress, various advantages are gained, amongst which, firstly a deep cleaning action upon treated surfaces, increasing the capacity to retain the fine dust particles and developing a cleaning action of the suctioned air. In addition, a greater versatility is noticeable, as it is able to also suction liquids used for washing surfaces. Secondly, the particular composition and structure of the filters decreases in more than satisfactory degrees the need for maintenance intervention, ensuring also a satisfactory working procedure even after various uses. Finally, the constructive characteristics of the machine offer an unequalled accessibility making any intervention both simple and rapid.

The above solution uses many filters which tends to decrease suction efficiency. Furthermore, the drops of water tend to rise in the container, impregnating the upper filters, and endangering the area where is situated the electric motor suction group is situated. As a result, regular maintenance is required, aimed at intervening regularly with regard to the said filters, drying them, and performing periodical checks on the motor area.

To furthermore solve this problem, advantageously the vacuum cleaner apparatus is already improved by providing it with a suspended removable baffle, of a circular configuration and with a funnel, suspended perimetrically from the cylindrical element inside said water container.

In this way, through the remarkable creative contribution which constitutes an immediate technical progress, various advantages are reached, firstly a careful separation from the treated water of the air to be re-introduced into the environment, that in this particular case is withheld inside the container without impregnating the upper filters. Any water which may be dispersed when strong shaking occurs, is collected by the oblique walls of the baffle and then precipitated into the underlying area. With regard to the effect on the suction cycle provoked by the presence of the baffle, it is possible to underline the fact that we obtain an optimization of the air distribution in the part underlying the filter of differentiated density, which is uniformly invested by the distributed air. Finally, the presence of a special filter in-set in correspondence with the suction mouth of the motor body, increases the capacity to retain the micro-dust particles thus further optimizing the washing of the air suctioned in this way.

BRIEF DESCRIPTION OF THE DRAWINGS

These and other advantages will be shown by the successive specified description of preferential solutions with the help of included schematic drawings, the execution particulars of which are not to be considered limitative but only illustrative.

Figure 4A:
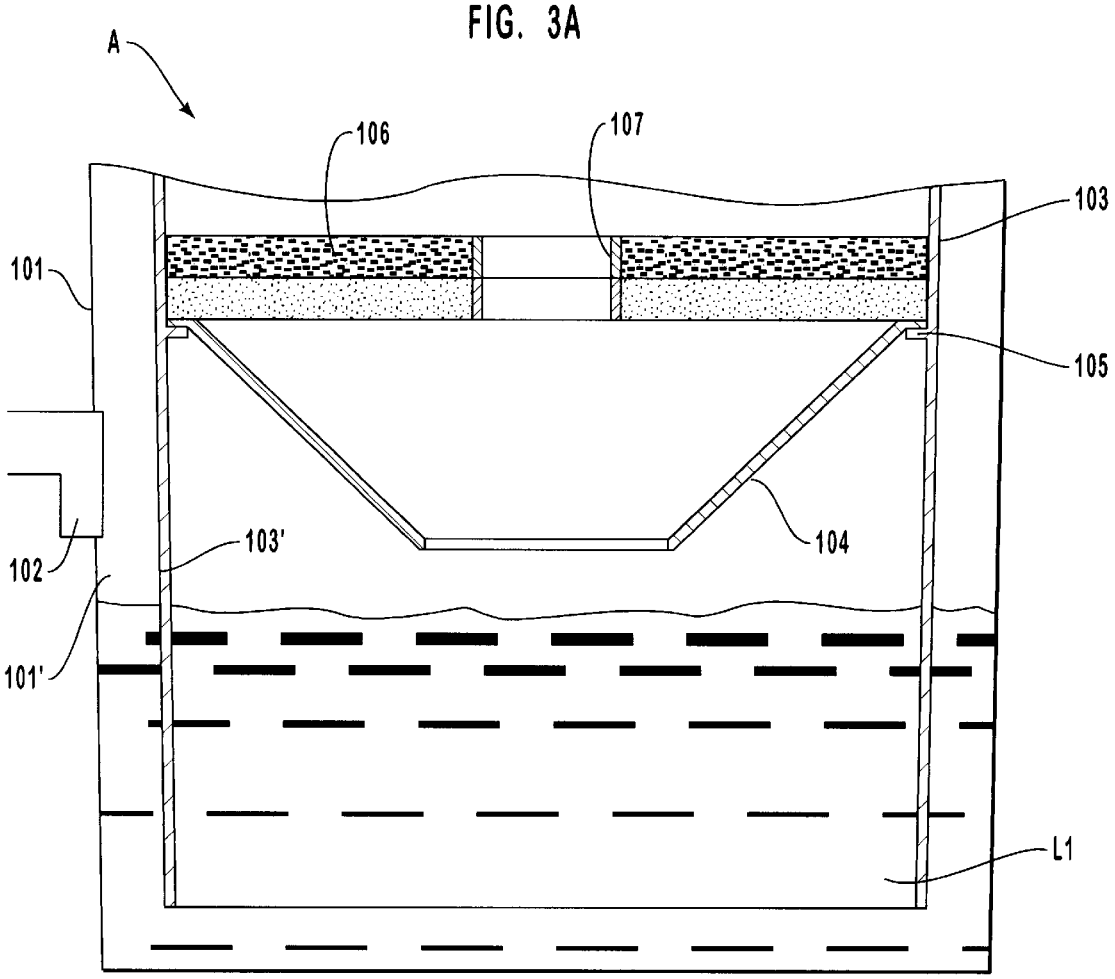
FIG. 4, represents a side-view of a second version of the vacuum cleaner apparatus in FIG. 1, of the type associated to a coaster.
Figure 4:
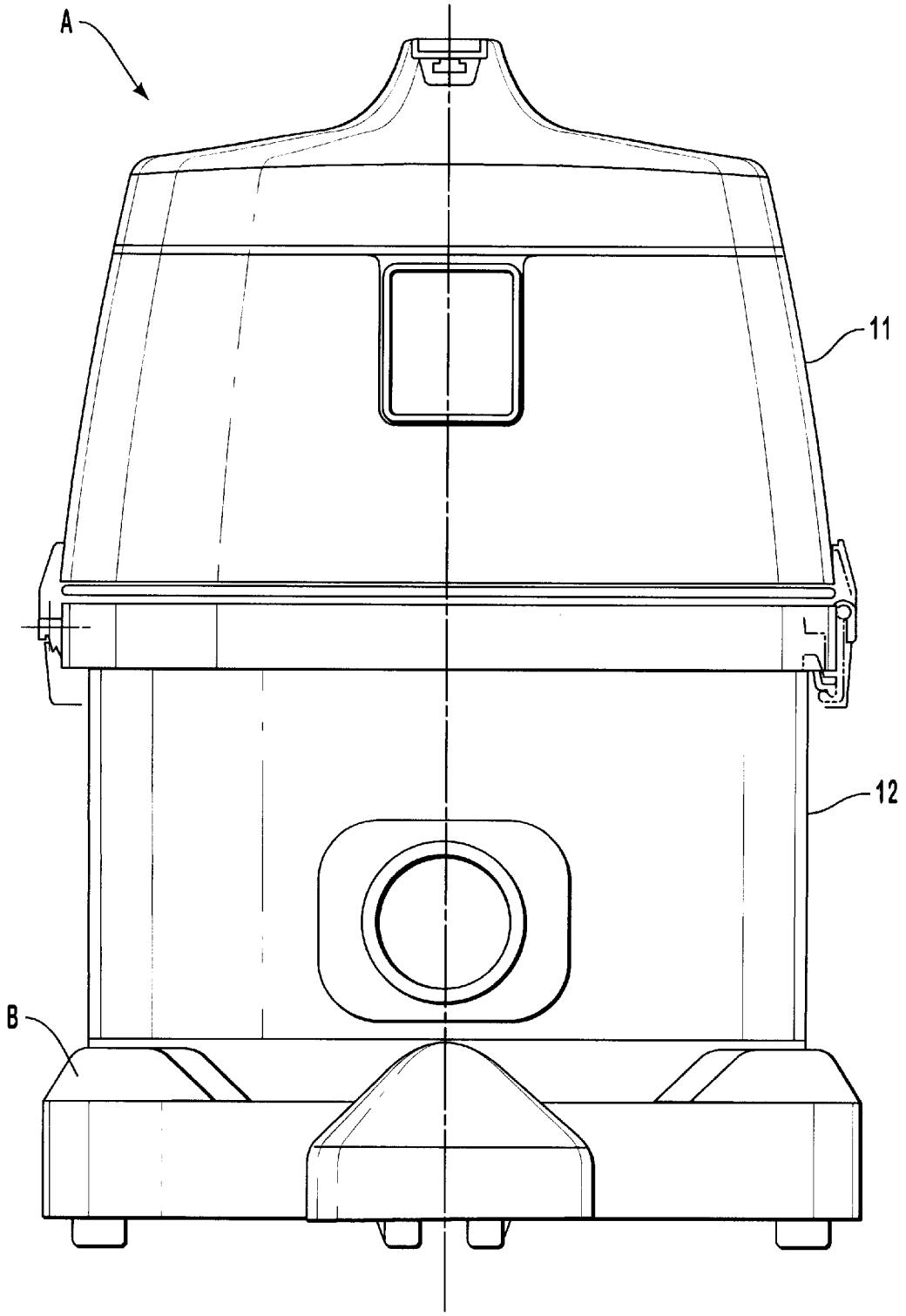
Figure 5:
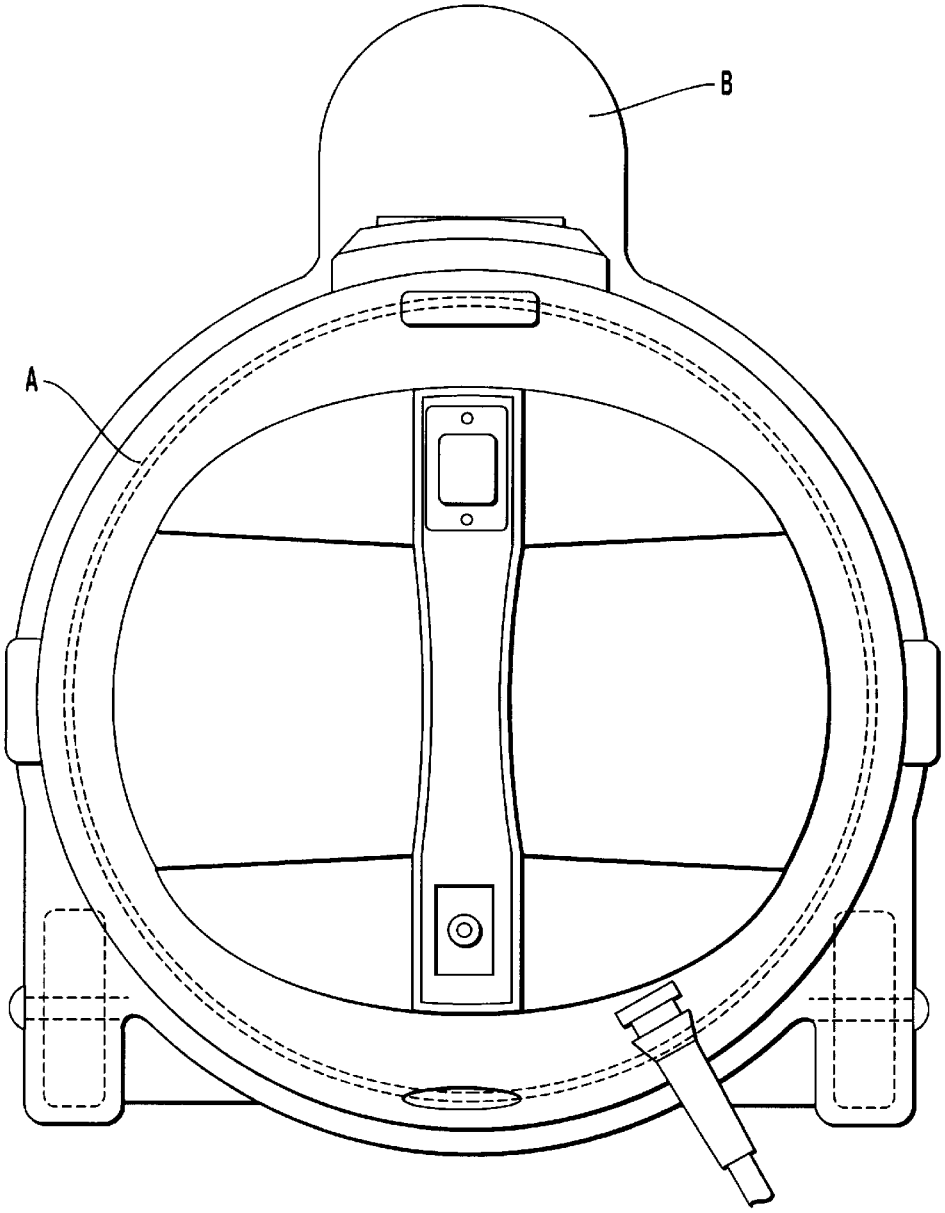
FIG. 5, illustrates a vacuum cleaner of the preceding Figure in a plane view.
Figure 6:
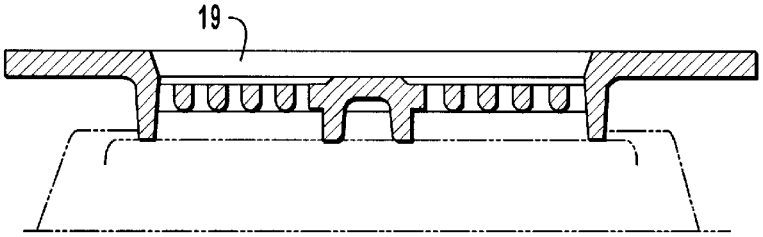
FIG. 6, is a sectional view of the particulars relative to the suction opening of the motor group on the inside of the body.
Figure 7:
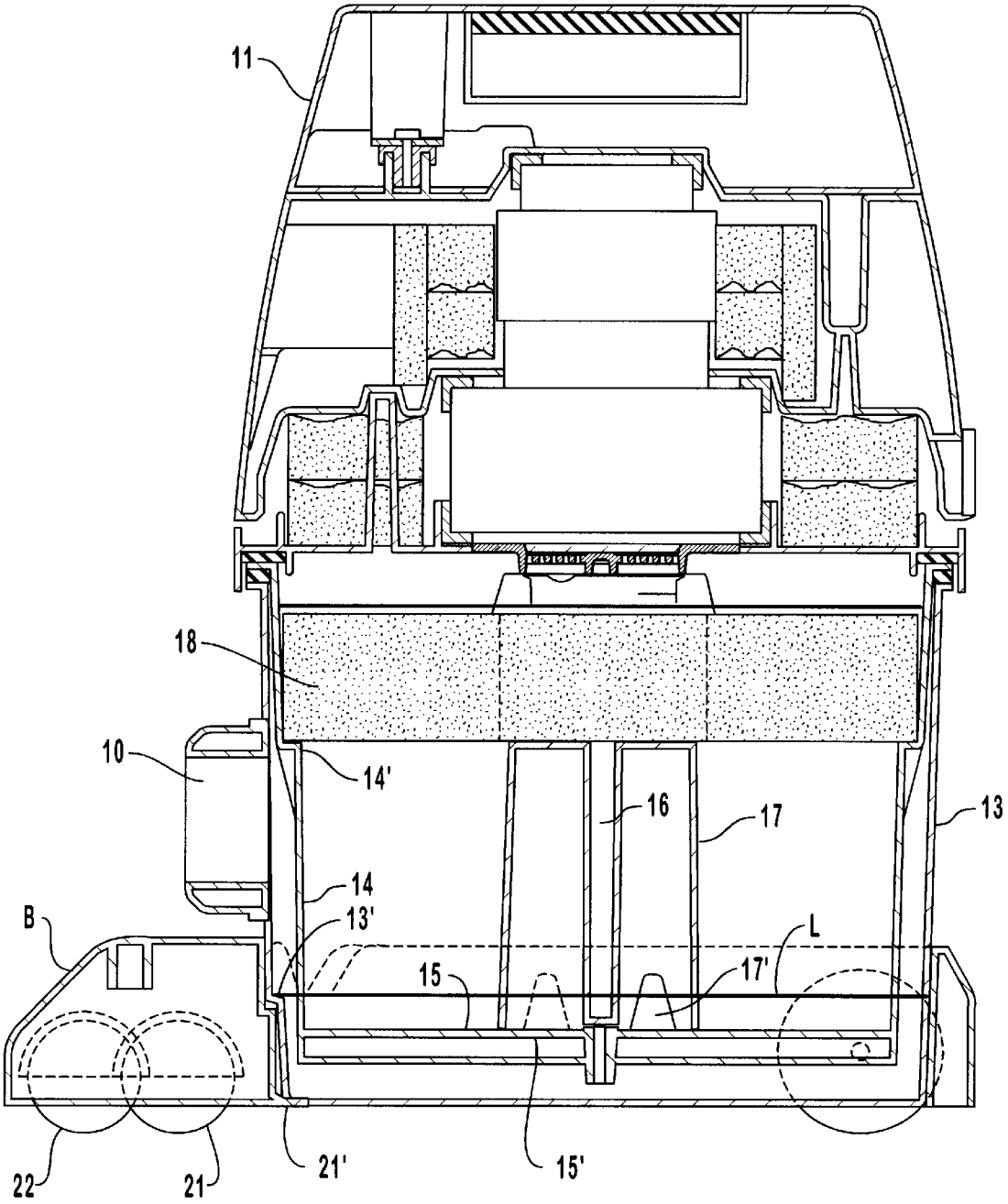

Finally, in FIG. 7, is shown, according to a longitudinal section, the interior of the vacuum cleaner in FIG. 4, along the axis Y—Y of FIG. 4.

Figure 1:
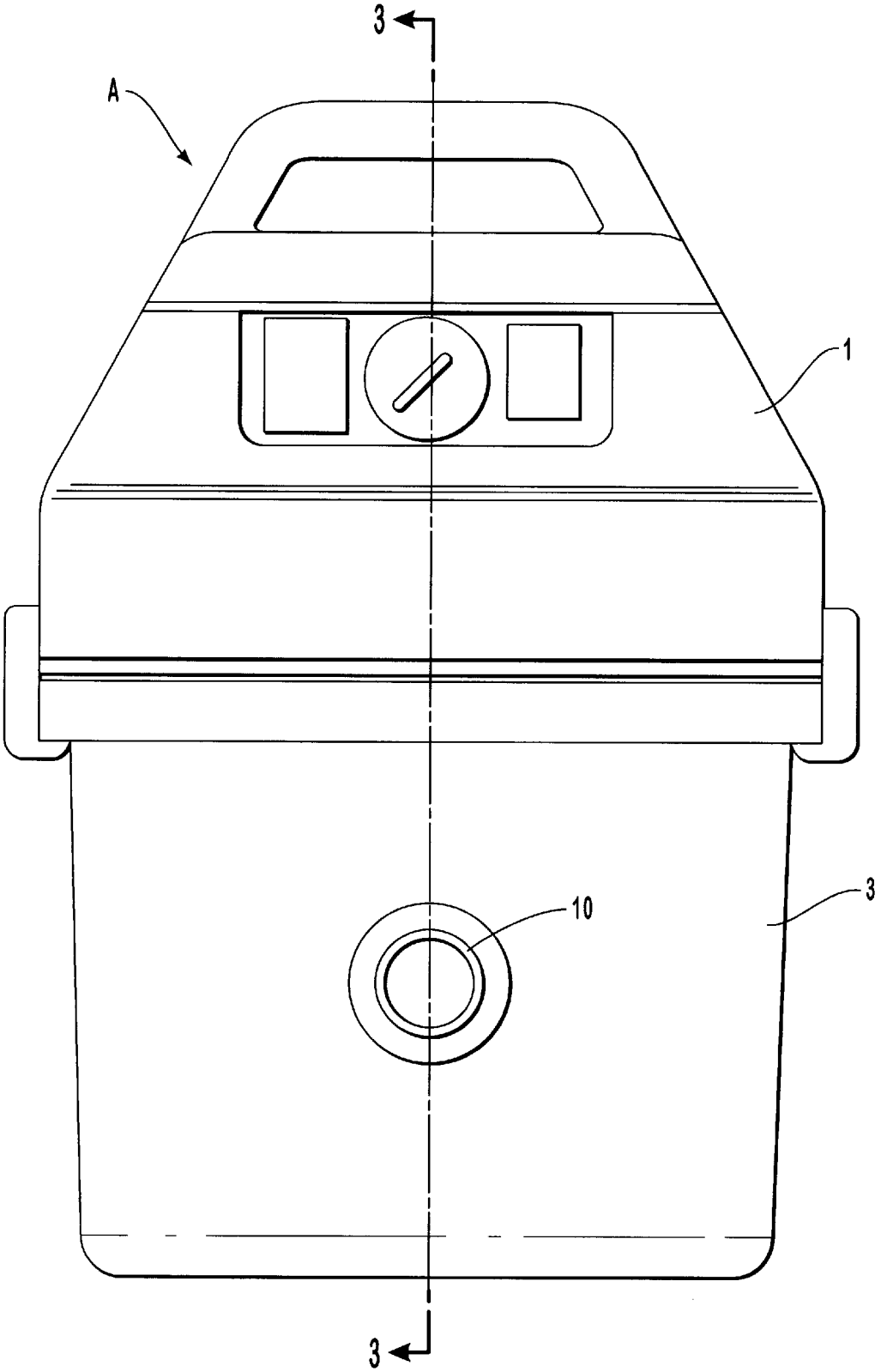
FIG. 1, represents a side-view of a vacuum cleaner apparatus.
Figure 1A:
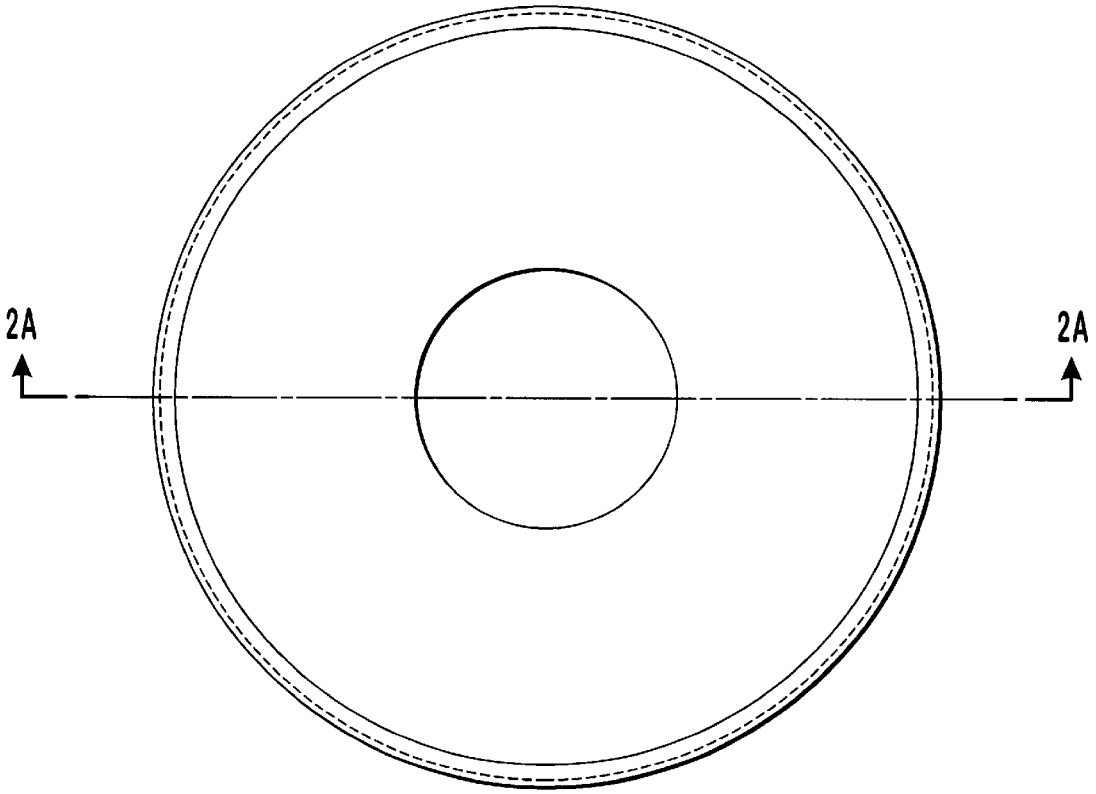

A further improved solution is disclosed in FIGS. 1A, 2A, 3A, 4A:

FIG. 1A, represents a plane view of a baffle device to be inserted inside a vacuum cleaner apparatus.

Figure 2A:
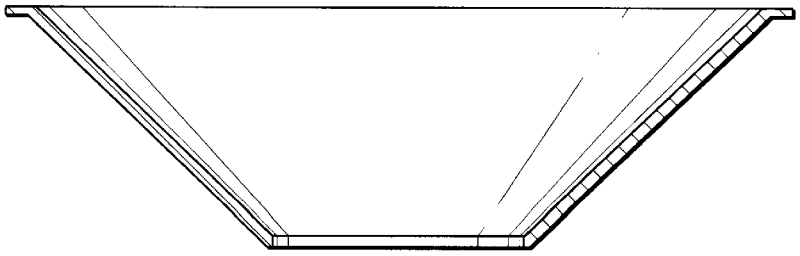
FIG. 2, represents a plane-view of the same vacuum cleaner apparatus as in the preceding Figure.
Figure 2:
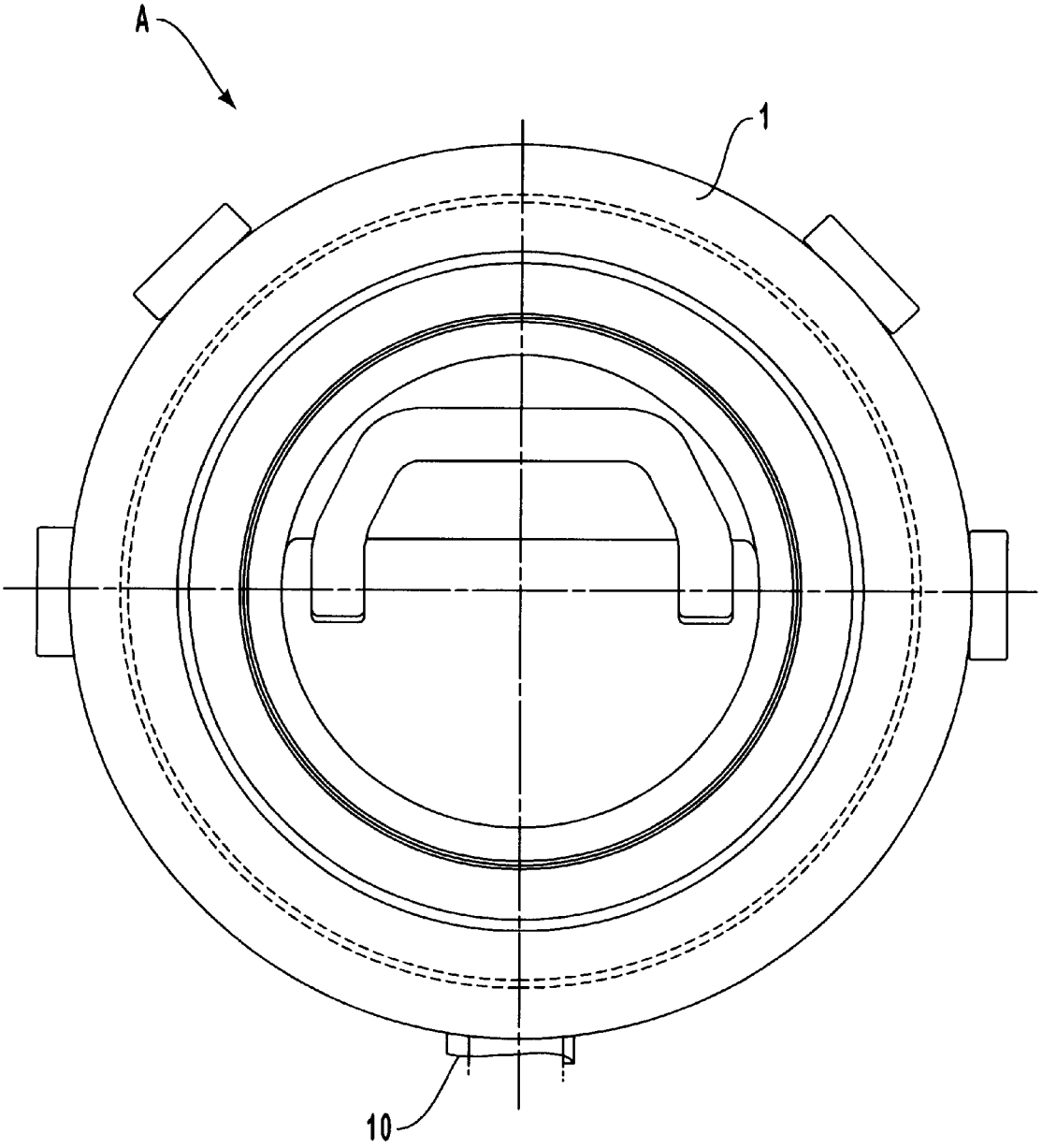

FIG. 2A, represents a sectional view of the baffle shown in the preceding Figure, taken along the transverse axis A—A.

Figure 3:
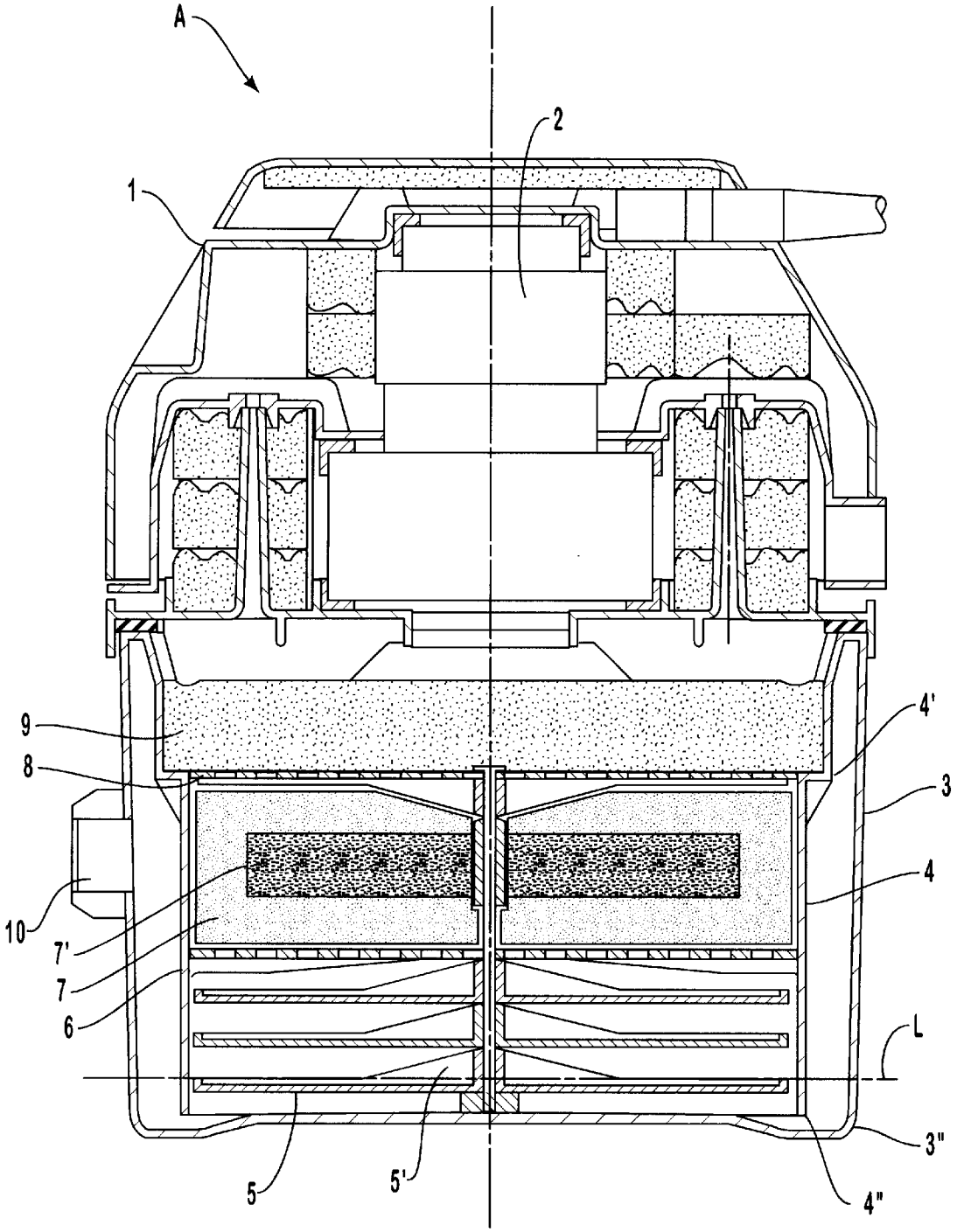
FIG. 3, represents a longitudinal view of the apparatus in the preceding Figures, taken along the axis X—X of FIG. 1.
Figure 3A:
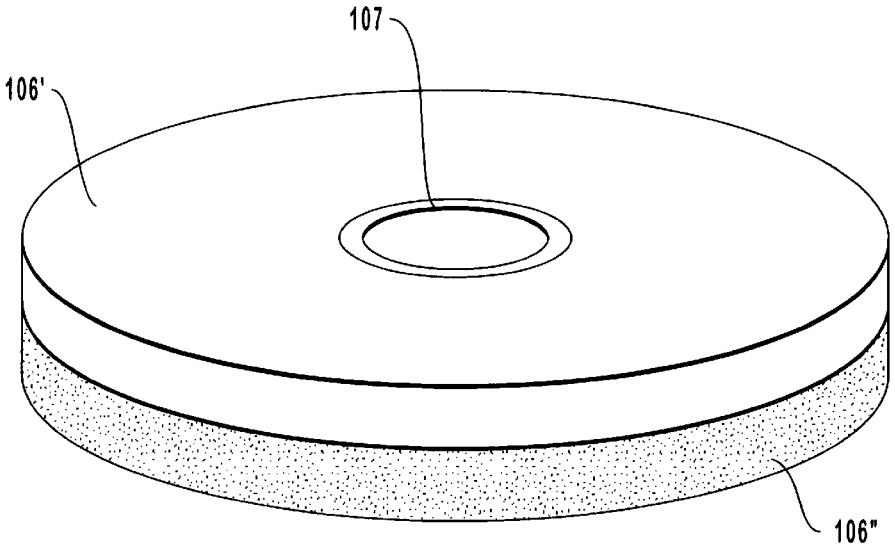

FIG. 3A, represents a view in perspective of a filter of the differentiated density type.

Finally, FIG. 4A. represents the internal part of a vacuum cleaner apparatus, seen partially and in section, having a baffle device and a upper filter of differentiated density.

DESCRIPTION OF THE PREFERRED EMBODIMENTS

Using the Figures for reference, it is disclosed that an apparatus (A), a vacuum cleaner and air purifier in particular, composed essentially of two parts, respectively a first comprising the body (1) support of the suction group (2), and a second, composed of a container (3) of water (L), preferably conical, inside of which is foreseen an ensemble of filters for cleaning the air suctioned into the aforesaid apparatus (A) by a suction means, for example, of the nosepiece type. More in detail the suction group (2) of the noted type, creates a depression in the underlying area, conveying to the inside of the apparatus (A), the air mixed with dust, previously removed and collected externally by the user by means of the aforesaid nosepiece joined to a mouthpiece (10) located on the side of the container (3). On the inside of the afore-mentioned structure is inserted (4) an almost cylindrical support for a group of filters, placed above a widening (4') proceeding upwards until the edge becomes folded over, protruding above the edge of the container (3).

In the present case, the structure (4) provides two distinct areas for filtering the suctioned air. Firstly, a lower area (b) comprising on all surfaces, a group of micro-perforated separator discs (5), with an upper stiffening ribbing (5'), while above the pile of discs which are adequately spaced one from the other by the same ribbing (5'), a second area (c), is subdivided from the preceding (b) by a base (6) also perforated and forming a single body with the structure (4). The base (6), above all, has the job of holding up a first very thick filter (7), of the type made of plastic with open cells. The filter (7), positioned above, is likewise maintained in a flat position by a plate (8) which is extractable and perforated similarly to the base (6), which constitutes a separating and supporting means for an upper filter (9). The latter, which has an air drying function, has a greater density, and occupies the area remaining between the surface of the plate (8) and the mouthpiece of the suction group (2). Again in a preferential solution, the filter (7) can provide an interspace in which a layer of activated charcoal is held (7'), functioning as an odour eliminator.

Following a first functioning phase, the air, suctioned inside the apparatus (A), is conveyed along the interspace (d) defined by the walls, respectively, of the external container (3) and of the filter support structure (4), and then forced downwards in the siphon defined by the level of water (L), until it surpasses the annular edge (4") of the structure bearing the filters. In this case, a raising of the central part of the bottom of the container (3) compared to the perimetrical support edge (3") is foreseen, resulting almost co-planar to the base of the wall of the cylindrical structure (4). Therefore we obtain, between the annular edge (4") of the structure (4) and the support surface (3"), a distance sufficient to make the suctioned air flow in the direction of the compulsory passage in which the group of filters act. The turbulence provoked in the water (L) as a result of the sudden passage of air, allows a first seizure of the dust, which precipitates to the bottom of the container (3). As the air re-ascends, it undergoes a progressive cleaning, passing through the different stages of filtration, from the first discs (5) to the successive filters with differentiated density (7), (8) and (9) to be released into the surrounding environment, by the suction group (2), almost deprived of the micro-dust.

In a second version, as illustrated in greater detail in the FIGS. from 4 to 7, the vacuum cleaner and air purifier (A), composed also of two parts, respectively the first, comprising the support body (11) of the suction group (12), and a second underlying part, composed of a container (13) of water (L), preferably conical. On the inside of the container (13) is similarly provided an ensemble of filters for the cleaning of the air and liquid suctioned inside the aforesaid apparatus (A) by means of a suctioning system, of the nosepiece type. More in detail, the suction group (12) of the known type, creates a depression in the underlying area, conveying inside the apparatus (A), the air mixed with dust and/or liquids, previously removed and collected externally by the user by means of the aforesaid nosepiece joined to a mouthpiece (10) positioned on the side of the container (13).

On the inside of the container (13) an almost cylindrical structure is inserted (14) to support a group of filters, provided at its upper end with a widening (14'), continuing upwards until folding over orthogonally, protruding above the edge of the container (13). The cylindrical structure (14), has only one base disc (15) fully submerged in the liquid (L), which being perforated (15'), even with varying diameters, allows a first separation of the dirt from the flow of introduced air. The base disc (15), monolithic with a cylindrical structure (14) provides a central hole for the support of a right angled beam (16) which acts as a guide for the shutter (17) inside of which it is inserted coaxially. More in particular, the shutter (17), is composed in practice of an overturned glass, which has along the edge, a series of openings (17') partially submerged in the level of liquid (L) inside the container (13). In this case, the head of the shutter (17) is co-planar to the base of a filter (18), held up by the tooth (14') obtained from the structure (14), and with a central hole (18') with a diameter at least equal to the diameter of the shutter (17). The hole (18') of the filter (18), corresponds above to a small suction opening (19) of the motor group (2), and is maintained at a distance by means of a series of fins (20) which spread out radially from the said opening (19).

The air to be treated is suctioned to the inside of the apparatus (A), passing through the opening (10), and is obliged to flow downwards along the annular interspace (d) defined by the walls of the container (13) and of the internal cylinder (14), until reaching the level of water (L). The siphon so obtained, allows all the dirt to be carried and deposited on the bottom, while the air firstly mixed with water and then nebulized, flows upwards, to be re-filtered, being separated definitively from the water, in accordance with a traditional technique. In the case of liquid suctioned from the exterior, it increases the pre-determined original level (L), sufficiently raising the shutter (17) due to the bubble of air held within it. With an excessive quantity of liquid, the shutter (17) rises until it comes into contact with the edge of the suction opening (19) which closes the entrance and prevents further functioning.

In both the solutions cited, a coaster is provided for movement (B), supplied with wheels (22) of which an anterior couple are pivoted, and from which the vacuum cleaner (A) is fully dissociable. The coaster (B), more in particular, is composed of a structure of plastic material with a circular support (21) and has the same conformation as the underside (13) of the vacuum cleaner (A). This case, along the external walls, and in proximity to the base of the container (13), has a tooth (13') attached to the front of the apparatus which is disposed in the position of a corresponding tooth (21") found on the wall of the circular support (21). This finally has a lower folded-over ring-like edge (21') that allows the vacuum cleaner (A) to be easily held up along the perimeter base.

With reference to the FIGS. 1A, 2A, 3A, 4A regarding the improved solution, it is revealed that an apparatus (A1) specifically a vacuum cleaner and an air purifier, is essentially composed of two parts, respectively a first part comprising the support body of the suctioning group, and a second part, composed of a container (101) of water (L1), wherein is foreseen at least one filter for the cleaning of the air drawn into the aforesaid apparatus (A1) by a suction means, for example, of the nosepiece type. More in detail the known type of suctioning group creates a depression in the underlying area, conveying inside the apparatus (A1), the air mixed with the dust, previously removed and collected from the exterior by the user by means of the aforesaid nosepiece connected to an opening (102) situated on the side of the container (101).

On the inside of said container (101) a removable cylindrical structure (103) is situated, whose walls (103') have maintained a certain distance from the facing parts (101') that so define the container (101). An annular interspace is thus obtained, on the inside of which the air and/or water collected externally will flow, to be successively suctioned towards the bottom of the container (101) filled with water (L1). Due to the effect of the depression obtained inside the separation chamber (103), the air drawn in from the outside crosses the siphon and proceeds upwards, first being suctioned by the mouth of the motor group (not illustrated) and then being re-introduced into circulation. During its passage, the air in the chamber (103) helps to shake the water, thus undergoing a type of washing, where the drawn-in dirt is separated and upon precipitating, is deposited gradually on the bottom.

With the aim of preventing the migration of water upwards into the apparatus (A1), caused both by suction and by shaking, a suspended baffle device is provided (104), supported by a protruding edge (105) obtained on the internal perimeter of the chamber (103). More in detail, the device (104), both metallic and plastic, has a particular funnel conformation, which allows for the division of the water mixed with air along the side walls (103') of the chamber (103) preventing the exit of the water, while the narrowing of the funnel end allows for a uniform distribution of the upward air flow. Furthermore, perimetrically to the baffle (104), a seal (104') is added, that allows the baffle to adhere perfectly to the chamber walls (103).

In this described solution, it is furthermore foreseen that, above the baffle (104) a differentiated density filter (106) simply rests. In this case, said filter (106) consists of a first layer (106') of alveolar material with open cells, covered on the upper surface and partially along the sides with a layer of filter-tissue (106") in whose central part an area is provided for the fixing of a handle (107).

Finally, with the aim of optimizing the filtering power, on the inside of the support body of the suctioning group, or, in other words, below the surface separating the motor body from the underlying container (101–103), there are a plurality of fins, disposed radially, and all of the same length, that protract approximately from the edge of the support and converge towards the suction mouth of the motor group.

Here, in the area underlying said mouth, in-set on the same plane and held by the same fins by which it is compressed along the side, is an umpteenth filter of the -absolute- type which retains the smallest particles.

I claim:

1. A vacuum cleaner comprising:

(a) a housing having a chamber bounded by a floor, a top, and an encircling sidewall extending therebetween, the chamber being configured to retain water therein;

(b) an inlet port extending through the sidewall;

(c) a tubular insert positioned within the chamber, the tubular insert having an interior surface defining a passageway extending between a first end and an opposing second end, a first perforated plate being mounted on the interior surface between the first end and the second end thereof so as to transverse the passageway, the first end of the insert being sealed around the interior surface of the housing between the outlet port and the cap, the second end of the insert being positioned at the floor of the housing;

(d) means positioned adjacent to the floor of the housing for effecting fluid communication between the inlet port and the passageway in the insert;

(e) a perforated dirt separator disk removably positioned within the second end of the passageway of the insert between the first perforated plate and the floor of the housing;

(f) a first filter removably positioned within the passageway of the insert adjacent to the first perforated plate on the side thereof opposite the perforated disk; and (g) means secured to the cover of the housing for sucking air through the passageway in the insert.

2. A vacuum cleaner as recited in claim 1, wherein the means positioned adjacent to the floor of the housing for effecting fluid communication between the inlet port and the passageway in the insert comprises an annular opening extending around the insert at the floor of the housing.

3. A vacuum cleaner as recited in claim 1, wherein the means secured to the cover of the housing for sucking air through the passageway comprises a suction motor attached to the cover.

4. A vacuum cleaner as recited in claim 1, further comprising a second perforated plate positioned within the passageway between the first end of the passageway and the first perforated plate.

5. A vacuum cleaner as recited in claim 4, further comprising a second filter positioned between the second perforated plate and the cover, the second filter having a greater density than the first filter.

6. A vacuum cleaner as recited in claim 1, further comprising a plurality of spaced apart micro-perforated dirt separator disks removably positioned within the second end of the passageway of the insert between the first perforated plate and the floor of the housing.

7. A vacuum cleaner as recited in claim 1, wherein said first filter comprises an intermediate inner layer of active charcoal.

8. A vacuum cleaner comprising:

(a) a lower body having a chamber bounded by a floor and an encircling sidewall upstanding from the floor, the sidewall terminating at an annular lip remote from the floor and having an inlet port extending therethrough, the chamber being configured to retain water therein;

(b) a tubular insert positioned within the chamber of the lower body, the tubular insert having an interior surface defining a passageway extending between an open first end and an opposing open second end, a rigid first perforated plate being mounted on the interior surface between the first end and the second end thereof so as to transverse the passageway, the second end of the insert being positioned adjacent to the floor of the lower body with an opening formed therebetween, the opening effecting fluid communication between the inlet port and the passageway;

(c) a micro perforated dirt separator disk removably positioned within the second end of the passageway of the insert between the first perforated plate and the floor of the lower body;

(d) a first filter removably positioned within the passageway of the insert adjacent to the first perforated plate on the side thereof opposite the perforated disk; and (e) an upper body comprising an annular body wall extending between a top end and an attachment end, the attachment end having an annular lip formed thereat, the annular lip of the upper body being releasably, sealably secured to the annular lip of the lower body, the body wall encircling a suction motor, the suction motor communicating with the first end of the passageway of the insert when the upper body is secured to the lower body.

9. A vacuum cleaner as recited in claim 8, further comprising a second perforated plate positioned within the passageway between the first end of the passageway and the first perforated plate.

10. A vacuum cleaner as recited in claim 9, further comprising a second filter positioned between the second perforated plate and the cover, the second filter having a greater density than the first filter.

11. A vacuum cleaner as recited in claim 8, further comprising a plurality of spaced apart micro-perforated dirt separator disks removably positioned within the second end of the passageway of the insert between the first perforated plate and the floor of the housing.

12. A vacuum cleaner as recited in claim 8, wherein said first filter comprises an intermediate inner layer of active charcoal.

* * * * *